US005639179A

United States Patent [19]

Jensen

[11] Patent Number: 5,639,179

[45] Date of Patent: Jun. 17, 1997

[54] TRAFFIC SAFETY CONTROL DEVICE

[76] Inventor: Kevin M. Jensen, 23110 - 13 PL W, Bothell, Wash. 98021

[21] Appl. No.: 519,412

[22] Filed: Aug. 24, 1995

[51] Int. Cl.[6] ..... E01F 13/00

[52] U.S. Cl. ..... 404/6; 404/7; 404/16

[58] Field of Search ..... 404/6, 7, 8, 9, 404/10, 14, 15, 16; 256/13.1; 116/63 R

[56] References Cited

U.S. PATENT DOCUMENTS

| | | | |
|---|---|---|---|
| D. 172,324 | 5/1954 | Wiswell | D72/1 |
| 2,208,080 | 7/1940 | Overdorff | 116/114 |
| 2,841,059 | 7/1958 | Wiswell | 94/1.5 |
| 2,851,935 | 9/1958 | Weeks | 94/1.5 |
| 3,065,680 | 11/1962 | Wiedman, Sr. | 94/31 |
| 3,658,300 | 4/1972 | Templeton | 256/13.1 |
| 3,954,346 | 5/1976 | Miller | 404/16 |
| 4,376,594 | 3/1983 | Prosenz | 404/6 |
| 4,463,934 | 8/1984 | Ochoa et al. | 256/13.1 |
| 4,474,503 | 10/1984 | Booth et al. | 404/6 |
| 4,594,021 | 6/1986 | Schäfer et al. | 404/14 |
| 4,681,302 | 7/1987 | Thompson | 256/13.1 |
| 4,762,438 | 8/1988 | Dewing | 404/6 |
| 5,104,254 | 4/1992 | Durand | 404/6 |
| 5,108,217 | 4/1992 | Bloom | 404/10 |
| 5,230,582 | 7/1993 | Schmitt et al. | 404/6 |
| 5,242,242 | 9/1993 | Young | 404/12 |
| 5,259,154 | 11/1993 | Lilley | 404/7 X |
| 5,306,105 | 4/1994 | Langbrandner et al. | 404/12 |
| 5,345,731 | 9/1994 | Sykes | 52/102 |
| 5,360,286 | 11/1994 | Russell | 404/6 |
| 5,403,115 | 4/1995 | Flader | 404/9 |
| 5,425,594 | 6/1995 | Krage et al. | 256/13.1 X |

*Primary Examiner*—James Lisehora
*Attorney, Agent, or Firm*—Dowrey & Associates

[57] ABSTRACT

A vehicular traffic control device having a body formed by a hollow, elongated shell with a central domed ridge, vertically curved side walls and laterally extending, pavement engaging footings. The shell is made from molded plastic so as to be light weight, highly portable and stackable. Friction pads are provided for the bottom pavement engaging surfaces of the footings and spaced bump reflectors are located on the top surfaces thereof. The shell may be reinforced by cross ribs and is provided with hinge devices for connecting the devices in tandem.

19 Claims, 3 Drawing Sheets

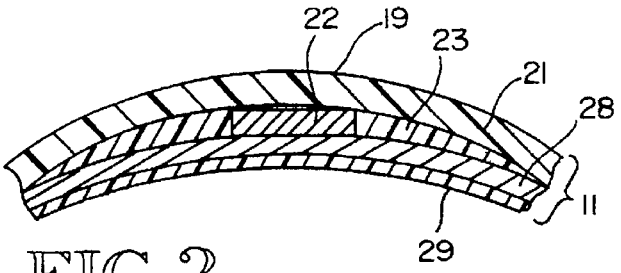
FIG. 2
FIG. 3
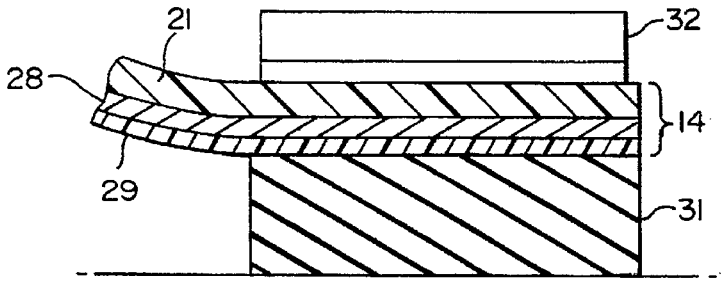
FIG. 4
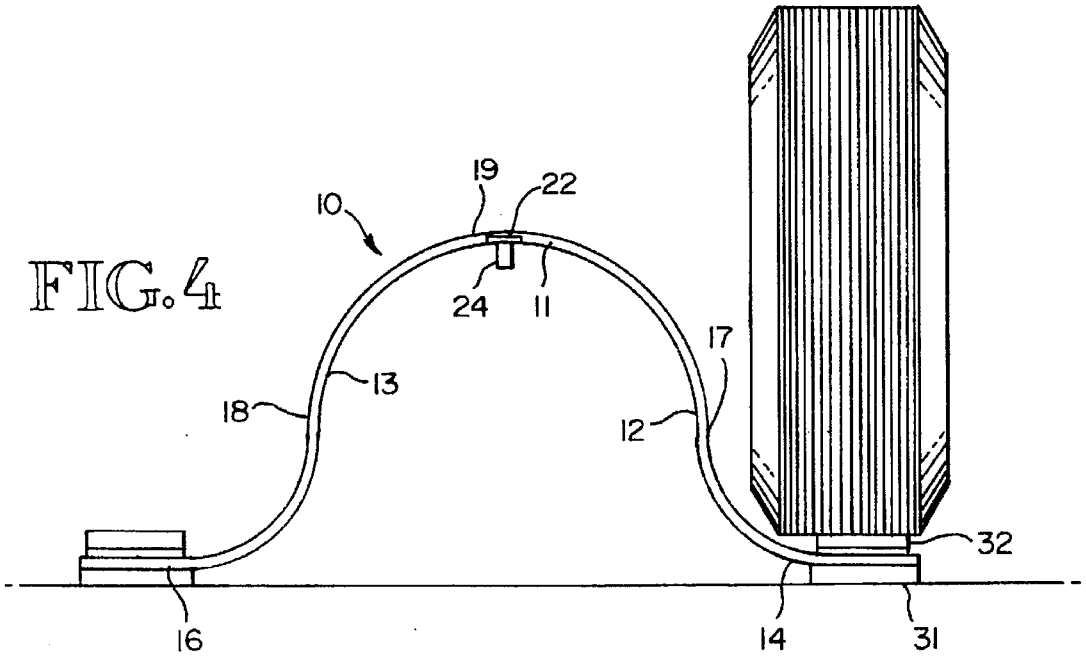

TRAFFIC SAFETY CONTROL DEVICE

BACKGROUND OF THE INVENTION

1. Field of the Invention

The present invention relates to vehicular traffic safety control devices and more particularly to a light weight highly mobile barrier or traffic channelizing structure designed for easy handling and quick deployment. The invention finds particular utility in the protection of personnel who must work in temporary construction zones in the presence of vehicular traffic. In one embodiment, the device functions as a barricade or barrier capable of deflecting the wheel of a vehicle so as to prevent the vehicle from climbing the side of the barrier at approach angles of up to approximately 20°–25°. In the second embodiment the device is used to channelize vehicular traffic as is done with highway marking cones and the like.

2. Description of the Prior Art

A wide variety of roadway traffic control and warning devices are in use today. These devices include visual markers, traffic bars which produce audible warnings when encountered by the tires of the vehicle, or flexible markers which present a psychological response of size or color, and actual energy absorbing barriers which prevent vehicle passage. The control devices may be either continuous or intermittent and have the object of guiding traffic movement, e.g. lane travel, so as to prevent vehicle collison or injury to pedestrians or workers present on the roadway.

Examples of purely visual control markers are illustrated in U.S. Pat. Nos. 3,954,346 to Miller, 5,306,105 to Langbrandner et al. and 5,403,115 to Flader. Traffic strips such as shown in the Miller and Langbrandner et al. patents may be made continuous and are usually adhered by adhesive or the like directly to the pavement surface. The Flader patent is an example of markers which are laid down in spaced relationship and may be arranged as desired to visually guide or warn the motorists. This type of marker is usually light reflective or brightly colored to attract the driver's attention. Another example of this type of marker is the continuous painted centerline or road edge strip for controlling lane traffic. Although effective for established avenues of unobstructed travel or normal cross-street and intersection traffic, these methods are not effective for emergency situations, detours, construction areas and the like because they offer no physical impairment to the movement of the vehicle or psychological effect on the driver and are ignored in many cases.

U.S. Pat. Nos. 2,841,059 to Wisewell and 5,242,242 to Young illustrate another type of traffic control device which provides not only a visual indication but also provides an audible warning to the driver. The devices may be brightly colored, have light reflectors and the like but are usually comparatively close to the pavement and provide no actual or psychological impediment to vehicle movement. The devices, however, are equipped with protrusions e.g. ribs or fins, which cause a noticeable, disagreeable jarring noise when run over by a vehicle without deflecting the steering wheel. Thus an impression of serious damage to the vehicle is created. By various connector means individual strips may be made continuous or they may be attached for intermittent use. Although such devices offer a deterrent to deviating from the indicated lane of travel there is no physical impairment to the vehicle movement and intentional crossover is easily accomplished. For this reason they are not effective to protect pedestrian traffic, workmen or other personnel on the roadway.

Another class of traffic control devices provides the advantages of both simple markers and audible warnings. Examples of this type of control device are found in U.S. Pat. Nos. 2,851,935 to Weeks and 5,108,217 to Bloom. These devices are usually of a size and configuration to give the impression of a solid barrier but are so constructed as to present only a soft impact without damage to either the control device or the automobile. For this reason, these markers are constructed of flexible materials such as rubber or plastic and are self restoring so as to survive impact by vehicles. They may be adhesively adhered to the roadway surface or permanently anchored. Other well known examples of self restoring markers are plastic cones, drums or vertical tubes which are temporarily set in place. These devices offer an immediate visual impression and even present some psychological reaction because of their size but offer no real impediment to passage of a vehicle thus offering little protection to the pedestrian or roadway worker.

The following listed patents provide still another type of temporary traffic control device.

| U.S. Pat. No. | Patentee |
|---|---|
| 4,376,594 | Prosenz |
| 4,463,934 | Ochoa et al. |
| 4,474,503 | Booth et al. |
| 4,681,302 | Thompson |
| 5,360,286 | Russell |

The above listed patents illustrate impact absorbing barriers which are either large enough in size and mass to actually stop the colliding vehicle or are so designed as to contact the vehicle tire and deflect the steering of the vehicle away from the barrier. Although this class of barrier may be temporary and portable and may be both intermittent and continuous, they are constructed from steel, concrete or other massive materials capable of absorbing the impact of either the vehicle or the vehicle wheel. These devices, usually through special design, present a form of anti-climbing surface making it difficult for a vehicle to climb up the side of the barrier when approached from an angle. Although this class of device is in wide use, especially for temporary traffic control in construction areas, they are expensive to manufacture and are not easily installed or moved because of their size and weight.

There is thus a need for a highly portable traffic control device which not only provides a psychological impediment to vehicular traffic such as visual and audible signals to motorists, when functioning as a channelizing device, but is also capable of providing an actual physical impediment to vehicular traffic approaching at an angle. The primary object of this type of barrier or barricade and channelizing device is that of protecting pedestrian traffic and personnel on the roadway. These functions must be accomplished while at the same time providing a highly mobile unit which may be quickly and easily installed and removed by hand without the necessity of expensive equipment.

SUMMARY OF THE INVENTION

The safety barrier and channelizing device of the present invention is a low profile/high performance device which offers pedestrians and road crew workers a safer working environment than can be provided by cones or flags in those instances where use of concrete or steel barricades and barriers is not warranted or not possible. The safety control device is designed to be deployed and set up by as little as two people since they are lightweight and easy to carry. In contrast to large cement barricades, there is no need for a crane or a crew of workers to set the barricades in place. The configuration of the unit provides for nesting and they may be stacked and loaded into a vehicle as small as a pickup truck for deployment. A dome shaped shell manufactured from high impact plastic, reinforced plastic or fiberglass composite is provided with a curved surface which prevents the tire from climbing over the barrier. The sides of the curved portion may be provided with a commercially available glossy epoxy coating which provides a surface with an extremely low coefficient of friction, causing the vehicle tire to be deflected rather than climb onto the barrier. The domed shaped shell is provided with longitudinally extending footings with road engaging surfaces which may be fitted with friction enhancing materials such as rubber or synthetic rubber compositions. The footings prevent the barrier from slipping laterally once an automobile tire and weight of the vehicle is placed on the lateral footing. To enhance the warning aspects of the device, reflectors such as speed bump reflectors may be attached to the top surfaces of the footings. The reflectors provide both a visual and an audible signal to the driver that the vehicle tire has contacted the barrier. The barrier units may also be reinforced by such means as longitudinally spaced metal cross ribs if necessary to strengthen the structure. Alternatively the reinforced plastic or fiberglass composite may be provided with ribbed surfaces for reinforcing, depending on strength requirements. As with concrete and other types of barriers and barricades, the units may also be aligned or connected together to form a curve by means of protruding hinge structures. Likewise, the units may either be strung continuously or placed intermittently along a course.

It is to be understood that it is within the scope of this invention to vary the size and internal structure to eliminate internal bracing and to vary the materials used in the shell, to adapt the invention for use as a channelizing device only. In this embodiment, the device is meant to yield and break away upon impact by an automobile, and does not function as a barrier. In this instance the shell may be fabricated from softer yieldable plastics similar to those presently in use for traffic cones and tubular markers. The unique configuration, however, enhances the psychological effect on the motorist and the advantages of mobility and ease of handling are achieved.

BRIEF DESCRIPTION OF THE DRAWINGS

FIG. 2 is partial cross section view taken along lines 2—2 of FIG. 1;

FIG. 3 is a partial cross sectional view taken along lines 3—3 of FIG. 1;

FIG. 4 is an end elevation of the barricade engaged by a vehicle tire;

DESCRIPTION OF THE PREFERRED EMBODIMENT

Figure 1:
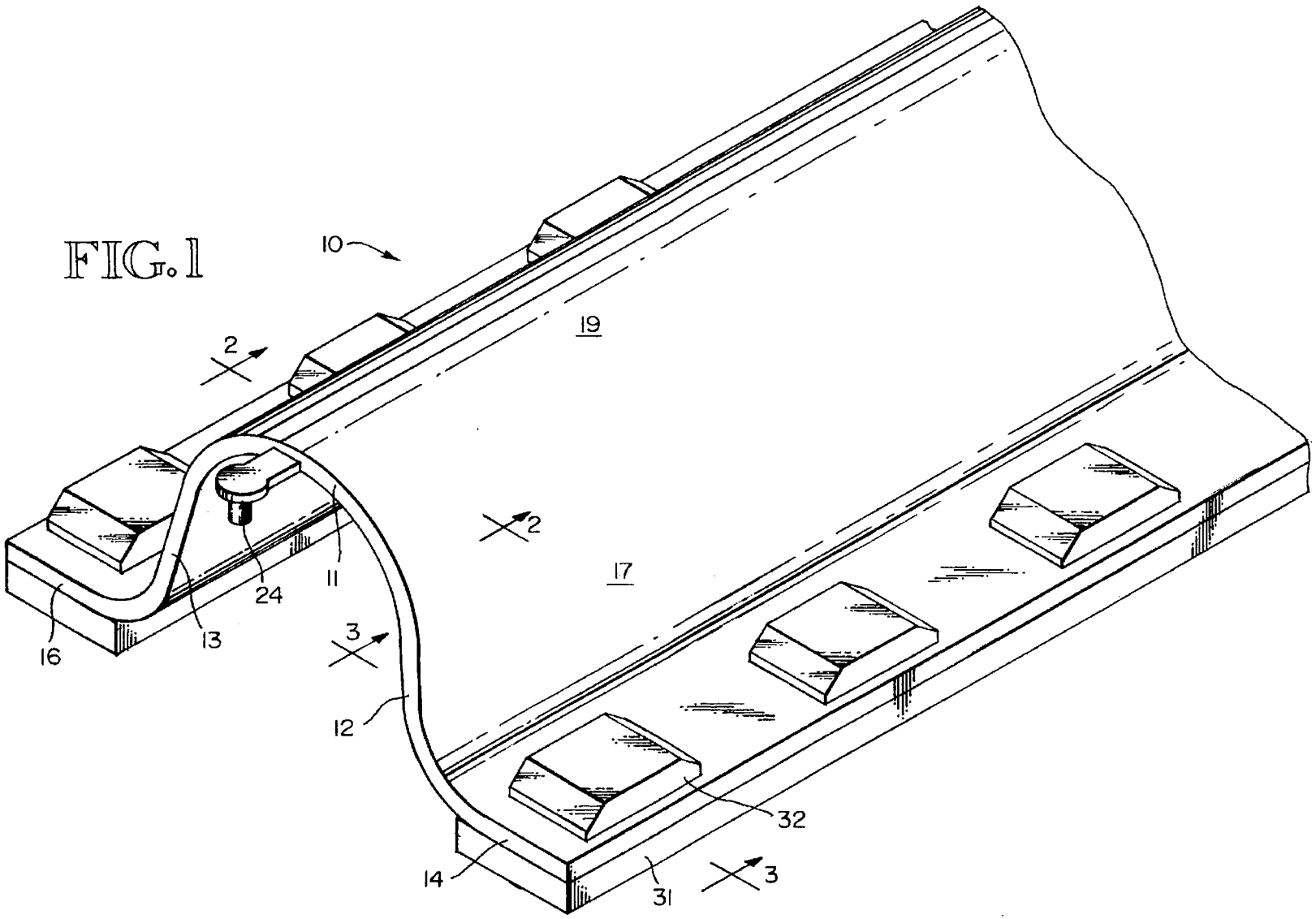
FIG. 1 is a perspective view of the safety barricade.
Figure 5:
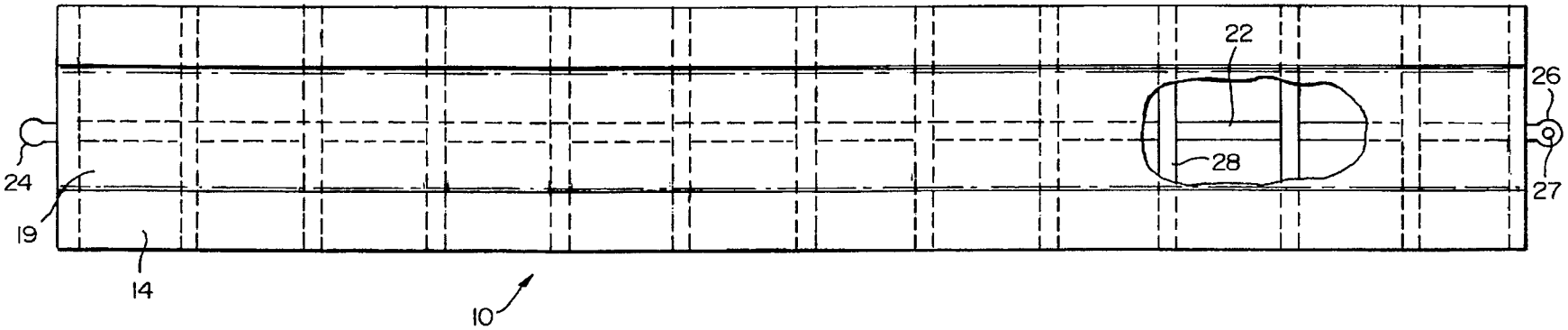
FIG. 5 is a top plan view of the barricade with a section removed to illustrate the position of the reinforcing members.

The body of the barrier 10 comprises a central arched portion 11 which forms a central convex hump or dome and the vertically curved side portions 12 and 13 which curve downwardly into the laterally directed horizontal footings 14 and 16. As shown in FIGS. 1 and 5 the domed configuration continues throughout the length of the barrier forming right and left anti-friction non-climb surfaces 17 and 18 as viewed in FIG. 4. The arched portion 11 forms the central crown or domed surface 19. In the preferred illustrated embodiment, intended for use as a barrier, the height of the dome is preferably approximately 16 inches although the height may be varied from 4 to 28 inches above the road surface depending on the function to be performed and design standards imposed by regulatory codes such as the Manual on Uniform Traffic Control Devices (MUTCD). The length of the barrier can vary between about 60 to 144 inches, again depending on design standards and intended use.

Figure 6:
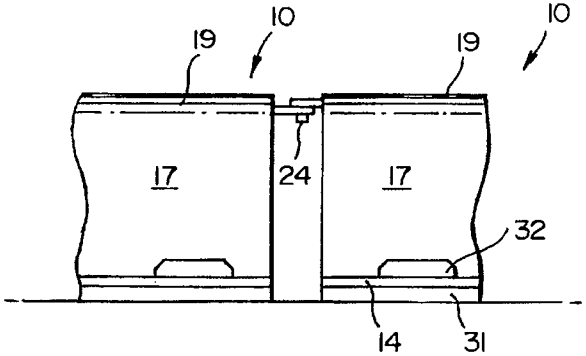
FIG. 6 is a partial elevation showing a hinge joint between barricade sections.
Figure 7:
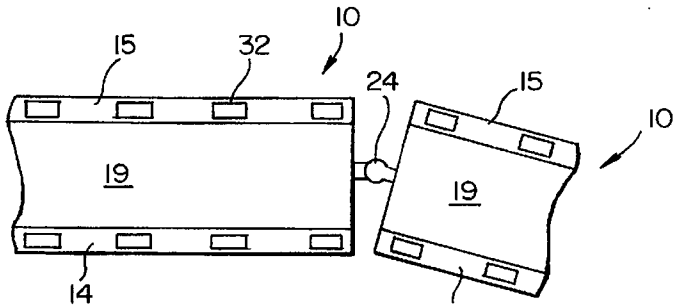
FIG. 7 is a plan view showing the hinged connection between barricade units arranged for a curved course.

As shown in cross section FIGS. 2 and 3, the body 10 is initially fabricated from high impact plastic compounds such as reinforced plastics and fiberglass composites, which form the outer layer 21. Although the plastic shell 21 may be formed by various methods it will be preferably formed by molding plastic under heat and pressure so as to attain its unique shape. The outer shell 21 may be coated with a commercially available glossy epoxy coating or the like, approximately 0.005 to 0.008 inches thick to provide a very low coefficient of friction to prevent the tires of an errant vehicle from climbing the barrier. In the present embodiment, a longitudinal connecting bar is placed on the underside of the central arched portion of the barrier body on the surface of the plastic shell and may be sealed to the underside of the shell by fiberglass/resin and/or plastic compounds as shown by the layer 23 in FIG. 2. The connecting bar 22 may be made of metal which also serves to add strength to the domed section of the shell. This seals the bar to the underside of the shell, adds to its strength and protects the connecting bar against the elements. The bar 22, as shown in FIG. 5, terminates at one end with a hinge pin configuration 24 and at the opposite end in a connector 26 having a central opening 27 for receiving the hinge pin 24 of a succeeding barrier section. In this manner, the barrier sections may be linked together as shown in FIG. 6 and articulated as shown in FIG. 7 to follow a curved course when required.

The outer shell can be constructed of reinforced plastic or composite material with or without steel reinforcement depending upon design parameters. For a shell made of plastics or fiberglass composite, light gauge steel ribs 28 may be necessary to provide sufficient strength in the structure. Referring to FIGS. 2 and 3, the ribs 28 are bent into the shape of the shell and span the width of the underside of the barrier. The ribs may be hardened/tempered and placed on the underside of the shell into the plastic compound mixture 23 covering the connecting bar. The longitudinal spacing of the ribs will be determined by the reinforcing strength desired. After the ribs are set into place, another layer of plastic compound 29 is applied to the entire underside of the shell. Thus, all metal supports are sealed within the plastic compound making the barrier extremely strong and resistant to damage. Although the illustrated embodiment utilizes metal ribs it will be understood that other forms of reinforcing for the shell are possible and fall within the purview of the invention. In some instances, the shell surface may be formed with thickened rib sections or curved surfaces for the desired strength.

As shown in FIG. 3, the footings 14 and 16 support the device and are provided with friction pads preferably extending the length of the shell. The pads 31 may be made of an friction enhancing material preferably comprised of ground recycled tires or the like. Although the barrier will tend to be held against the roadway the weight of an automobile tire riding on the footings 14 or 16, it is also possible to anchor the footings to the road surface if necessary to meet regulatory standards for highway barriers. Combination speed bumps and reflectors 32, rigidly mounted on the footings 14 and 16, provide visual cues to oncoming traffic and alert the drive with sounds and vibration imparted to the vehicle when the barrier is contacted.

When adapted for use as a channelizing device, the dome height can range from 4 to 28 inches, with a total suggested width of about 18 inches. In this embodiment, the shell is preferably made of flexible plastic with sufficient rigidity to retain its shape, marked with prominent reflective indicia, and a low friction coated such as epoxy applied. It is important in this configuration that the device break away when struck by an automobile and not produce anything that would fragment and potentially injure roadside workers or the occupants of the automobile. For this reason, no rigid reinforcement or internal structure is used.

Although preferred embodiments of the invention have been shown and described herein with certain specific modifications, it is understood that the present disclosure is made by way of example and that various other embodiments and modifications are possible without departing from the inventive concept and are included within the scope of the following claims, which claimed subject matter is regarded as the invention. The aim of the appended claims therefore, is to cover all such changes and modifications as fall within the true spirit and scope of the invention.

What is claimed is:

1. A light weight portable vehicular traffic safety control device comprising in combination;

an elongated hollow shell having a central domed ridge extending the full length thereof and including terminal ends and an inside concave surface, said shell including opposite vertically curved longitudinal side panels terminating in laterally extending footing members extending the substantial length of said shell, said footing members having substantially horizontally extending walls connected to said side panels with pavement engaging bottom surfaces thereon and top horizontal surfaces adapted for engagement with an approaching vehicle tire, the inside surface of said hollow shell being substantially unobstructed and forming a cavity extending substantially the full length of said shell, whereby the weight of a vehicle on said top surface enhances the frictional engagement between the footing and the pavement and a plurality of said shells may be stacked in nesting relation.

2. The device of claim 1 wherein the opposite ends of said elongated shell are open, the combination including;

friction pads fixed on the bottom surface of said footing members for enhancing the frictional engagement with the pavement.

3. The device of claim 2 including;

a plurality of longitudinally spaced protrusions on said top surface of the footing members for producing vibrations when contacted by the tire of a moving vehicle.

4. The device of claim 3 wherein said protrusions include light reflecting areas for visually warning the driver of an approaching vehicle.

5. The device of claim 2 wherein said friction pads comprise elastomeric material adhesively bonded to said bottom surface.

6. The device of claim 4 including hinge means attached to said shell on each end thereof for pivotally connecting successive shells to form a continuous line of control devices.

7. The device according to claim 4 wherein said side panels include surfaces for contacting the wheel of a moving vehicle, and including;

an anti-friction coating on the surface of said side panels for preventing the wheel of a moving vehicle from climbing said panels when approached at an angle thereto.

8. The device according to claim 7 wherein said domed ridge is located from 4–28 inches above said footing members and the length of said shell is from 60–144 inches.

9. The device according to claim 8 wherein said domed ridge is located approximately 16 inches above said footing members.

10. The device according to claim 1 wherein said shell comprises a thin molded plastic material, said plastic material comprising a rigid light weight shell body, whereby said device may be used as a traffic barrier.

11. The device according to claim 10 including;

reinforcing means for rigidifying said shell.

12. The device according to claim 11 wherein said reinforcing means comprises rigid metallic cross ribs attached to the inside surface of said shell conforming substantially to the contour thereof and located at spaced intervals along the length thereof.

13. The device according to claim 12 including friction pads fixed on the bottom surface of said footing members for enhancing frictional engagement with the pavement.

14. The device according to claim 13 including;

a plurality of longitudinally spaced protrusions on said top surface of the footing members for producing vibrations when contacted by the tire of a moving vehicle.

15. The device according to claim 14 wherein said protrusions include light reflecting areas for warning the driver of an approaching vehicle.

16. The device according to claim 15 wherein said friction pads comprise elastomeric material adhesively bonded to said bottom surfaces.

17. The device of claim 10 including;

friction pads fixed on the bottom surface of said footing members for enhancing the frictional engagement with the pavement, and a plurality of longitudinally spaced protrusions on said top surfaces of the footing members for producing vibrations when contacted by the tire of a moving vehicle, said protrusions including light reflecting areas for visually warning the driver of an approaching vehicle.

18. A vehicular traffic safety control device comprising in combination;

a rigid light weight elongated hollow shell body comprising a thin molded plastic material, said shell having a central domed ridge extending the full length of said shell with opposite vertically curved longitudinal side panels terminating in laterally extending footing members extending the substantial length thereof, top horizontal surfaces on said footing members extending the substantial length of said shell adapted for engagement with an approaching vehicle tire, rigid metallic cross ribs connected to said shell and located at spaced intervals along the length thereof, elastomeric friction pads adhesively bonded to the bottom surface of said footing members for enhancing frictional engagement with the pavement, a plurality of longitudinally spaced protrusions on said top surface of the footing members for producing vibrations when contacted by the tire of a moving vehicle, said protrusions including light reflecting areas thereon for warning the driver of an approaching vehicle, said shell including terminal ends and an inside surface with a metal hinge bar attached thereto and extending the full length thereof, and connector members on each end of said hinge bar extending beyond the terminal ends of said domed ridge, said connector members being provided with hinge apparatus for pivotally connecting succeeding shells to form a continuous line of control devices.

19. A light weight portable vehicular traffic safety control device comprising in combination;

an elongated thin hollow rigid plastic shell having a central domed ridge extending the full length thereof and including terminal ends and an inside surface, said shell including opposite vertically curved longitudinal side panels terminating in laterally extending footing members, a metal hinge bar attached to the inside surface of said central domed ridge extending the full length thereof, and connector members on each end of said hinge bar, said connector members being provided with hinge apparatus for pivotally connecting succeeding shells to form a continuous line of control devices.

* * * * *